US006015144A

United States Patent [19]

Yoshii et al.

[11] Patent Number: 6,015,144

[45] Date of Patent: Jan. 18, 2000

[54] SHEET FEEDER AND IMAGE FORMING APPARATUS

[75] Inventors: Hajime Yoshii; Takuo Matsumura, both of Ebina, Japan

[73] Assignee: Fuji Xerox Co., Ltd., Tokyo, Japan

[21] Appl. No.: 09/059,334

[22] Filed: Apr. 14, 1998

[30] Foreign Application Priority Data

| | | | |
|---|---|---|---|
| Apr. 18, 1997 | [JP] | Japan | 9-101194 |
| Nov. 25, 1997 | [JP] | Japan | 9-322648 |
| Dec. 5, 1997 | [JP] | Japan | 9-335221 |

[51] Int. Cl.[7] ..... B65H 3/14

[52] U.S. Cl. ..... 271/97

[58] Field of Search ..... 271/3, 11, 5, 97, 271/112

[56] References Cited

U.S. PATENT DOCUMENTS

| | | | |
|---|---|---|---|
| 5,110,110 | 5/1992 | Wirz et al. | 271/97 X |

FOREIGN PATENT DOCUMENTS

| | | | |
|---|---|---|---|
| 61-21735 U | 2/1986 | Japan . | |
| 62-249835 | 10/1987 | Japan . | |
| 3-211136 | 9/1991 | Japan . | |
| 4-23747 | 1/1992 | Japan . | |
| 423747 | 1/1992 | Japan | 271/97 |

*Primary Examiner*—David H. Bollinger
*Attorney, Agent, or Firm*—Oliff & Berridge, PLC

[57] ABSTRACT

A sheet feeder includes: air blowing device which blows air from a direction of side edges of a stack of sheets loaded in a predetermined location, paper feed device which separates one sheet from the stack of sheets to which air is blown by the air blowing device and which feeds the thus-separated sheet from the predetermined location, and air flow regulation device which is provided in an elevated position above the stack of sheets loaded in the predetermined location and which regulates the passage of the air flow blown toward the stack of sheets from the air blowing device.

3 Claims, 16 Drawing Sheets

SHEET FEEDER AND IMAGE FORMING APPARATUS

BACKGROUND OF-THE INVENTION

1. Field of the Invention

The present invention relates to a sheet feeder which feeds one sheet at a time by separating a stack of sheets loaded on a paper feed tray one by one, as well as to an image forming apparatus having the sheet feeder.

2. Description of the Related Art

Conventionally, in an image forming apparatus, such as a copier or a printer, single-cut sheets which can feed continually are usually limited to bond paper or plain paper designated by the manufacturer of the copier. Since such paper has a low degree of surface smoothness, there is no risk of feeding doubled or overlapped sheets because of absorption between sheets when sheets are withdrawn one at a time from the loaded bundle of paper. On the other hand, in association with recent diversification of a recording medium, there is a growing demand for formation of an image on a sheet having a smooth surface, such as art paper or coat paper which is coated with a view to giving paper a high gloss and brightness and to responding to market demands for color printing, as well as on paper for use with an over-head projector, cardboard, or tracing paper. Such paper, i.e., paper for use with an over-head projector, tracing paper, art paper, or coat paper, has a high degree of surface smoothness. In a case where such paper is loaded at high humidity, sheets of paper attach together, the existing image forming apparatus suffers several problems such as feeding of overlapped sheets or feeding errors.

To solve the foregoing problems, there has already been proposed, for example, a method which uses a paper feeder 1 shown in FIG. 24 and which is described in Japanese Patent Application Laid-open No. Sho-62-249835. Under this method, air is blown by an air blower 7 to the leading side end of the stack of sheets 5 loaded on a paper feed table 3 from a direction parallel to the upper surface of the sheets 5. At the same time, a negative pressure is applied from an unillustrated negative pressure generator to an air supply cylinder 9 having an opening located at a position above the sheet 5, thus drawing external air in the vicinity of the opening 11 into the air supply cylinder 9. In this paper feeder 1, the topmost paper of the sheets 5 loaded on the paper feed table 3 is slightly floated in the air by drawing action through the opening 11, and air is blown from the air blower 7 toward a clearance formed between the topmost sheet 5 and the second-top sheet 5, thus ensuring separation of sheets.

There has also been proposed another method which uses a paper feeder 13 shown in FIGS. 25 to 27 and which is described in Japanese Patent Application Laid-open No. Hei-4-23747. Under this method, air blowing means 15 blows air toward the sheets 5 from a supply opening 19 formed opposite the side edges of the sheets 5, thus floating up the sheet 5. In cooperation with a-rolled, brush-shaped, or plate-shaped sheet press member 17 in contact with the upper surface of the sheet 5, air is introduced to the space between the sheets, thus separating the sheets 5 one by one. If there is not the sheet press member 17, a greater number of sheets than are required are floated into the air, so that a few sheets in the vicinity of the topmost sheet become insufficiently separated. However, the paper feeder 13 is capable of preventing the sheets 5 from being excessively floated into the air, as well as of introducing air into the space between the sheets, thus weakening attracting force acting between sheets and ensuring separation of sheets.

Still another type of paper feeder is described in Japanese Utility Model Application Laid-open No. Sho-61-21735, wherein a ventilation port is formed in the side surface of a paper feed tray, as well as being connected to an air blower through a pipe. Yet another type of paper feeder is described in Japanese Patent Application Laid-open No. Hei-3-211136, wherein an air flow to be blown toward the side surface of sheets is changed.

However, for the purpose of separating sheets by blowing air toward the side surface of the leading end of sheets and by drawing the topmost sheet upwardly, the paper feeder 1 of FIG. 24 must be provided with the air blower 7, the air supply cylinder 9, and a negative pressure generator, thereby rendering the paper feeder bulky, adding to the cost of products and running costs, and resulting in an increase in noise. Even the paper feeder having the air blower connected to the ventilation port through a pipe or the paper feeder which changes an air blow to be blown toward sheets becomes bulky and results in an increase in the cost of products.

In contrast, the paper feeder 13 of FIG. 25 that separates sheets by means of the air blowing means 15 and the sheet press member 17 is capable of manufacturing products at comparatively low expenses. However, in a case where paper is cut, thus producing large burrs which in turn close the spaces among sheets, or where the edges of the sheets are in a ragged state and become misaligned in a moving-away direction relative to an air supply opening, a small volume of air fails to enter the spaces among sheets. Consequently, the volume of air must be increased, thus adding to running costs and resulting in an increase in noise.

In the case of a paper feeder shown in FIG. 28A in which air blowing means 28 blows air toward the side surface of sheets loaded on a paper feed tray, thus causing a sheet to blow off and separating closely-attached sheets, if air is blown toward the side edges of the sheets at one time in a manner as shown in FIG. 28B, sheets positioned above a boundary surface 19 where sheets weakly attach to each other are caused to blow off in a stacked manner as shown in FIG. 28C. Consequently, it becomes impossible to let air through the spaces among the stack of sheets floating in the air, so that the sheets remain attached to one another. Eventually, the paper feeder causes feed errors or feeding of overlapped sheets.

SUMMARY OF THE INVENTION

The present invention has been conceived in view of the foregoing drawbacks in the art, and the primary object of the present invention is to provide a sheet feeder which provides a great force to separate sheets with a small volume of air supply and which ensures separation of sheets, as well as to provide an image forming apparatus adopting the sheet feeder, with a view toward achieving a compact sheet feeder, a lower cost of products, lower running costs, low noise, and improved reliability of paper feeding operation.

The second object of the present invention is to provide an image forming apparatus which prevents sheets located above a boundary surface where sheets weakly attach to each other from rising when the top sheet blows off, thus preventing feeding errors or feeding of overlapped sheets.

According to the invention, to accomplish the foregoing objects, there is provided a sheet feeder including: air blowing device which blows air from a direction of side edges of a stack of sheets loaded in a predetermined location, a paper feed device which separates one sheet from the stack of sheets to which air is blown by the air blowing device and which feeds the thus-separated sheet from the predetermined location, and an air flow regulation device which is provided in an elevated position above the stack of sheets loaded in the predetermined location and which regulates the passage of the air flow blown toward the stack of sheets from the air blowing device.

Further, there is provided an image forming apparatus including: an operation section from which an instruction related to image formation is issued, a sheet tray on which a stack of sheets used for forming an image are loaded, an air blowing device which blows air from a direction of side edges of the stack of sheets loaded on the sheet tray, a paper feed device which separates one sheet from the stack of sheets to which the air is blown from the air blowing device and which feeds the thus-separated sheet from the sheet tray, a raising-and-lowering device which raises and/or lowers the stack of sheets loaded on the sheet tray in such a way that the air flow blown from the air blowing device is blown toward a boundary between the topmost sheet and a subsequent sheet of the stack of sheets in the direction of the side edges of the stack of sheets; and a control device which controls so as to actuate the air blowing device and the raising-and-lowering device in accordance with an instruction from the operation section.

In addition, instead of the raising-and-lowering device, the image forming apparatus may have an air flow control device which controls the passage of air so as to blow the air flow toward the side edges of the sheets in such a way that the air flow is blown in a sequential order to a boundary between the topmost sheet and the subsequent sheet of the stack of sheets. Then, the control device controls actuation of the air blowing means and the air flow control device in accordance with an instruction from the operation section.

DETAILED DESCRIPTION OF THE PREFERRED EMBODIMENTS

A paper feeding method and an image forming apparatus according to preferred embodiments of the present invention will be described in detail by reference to the accompanying drawings.

Figure 1:
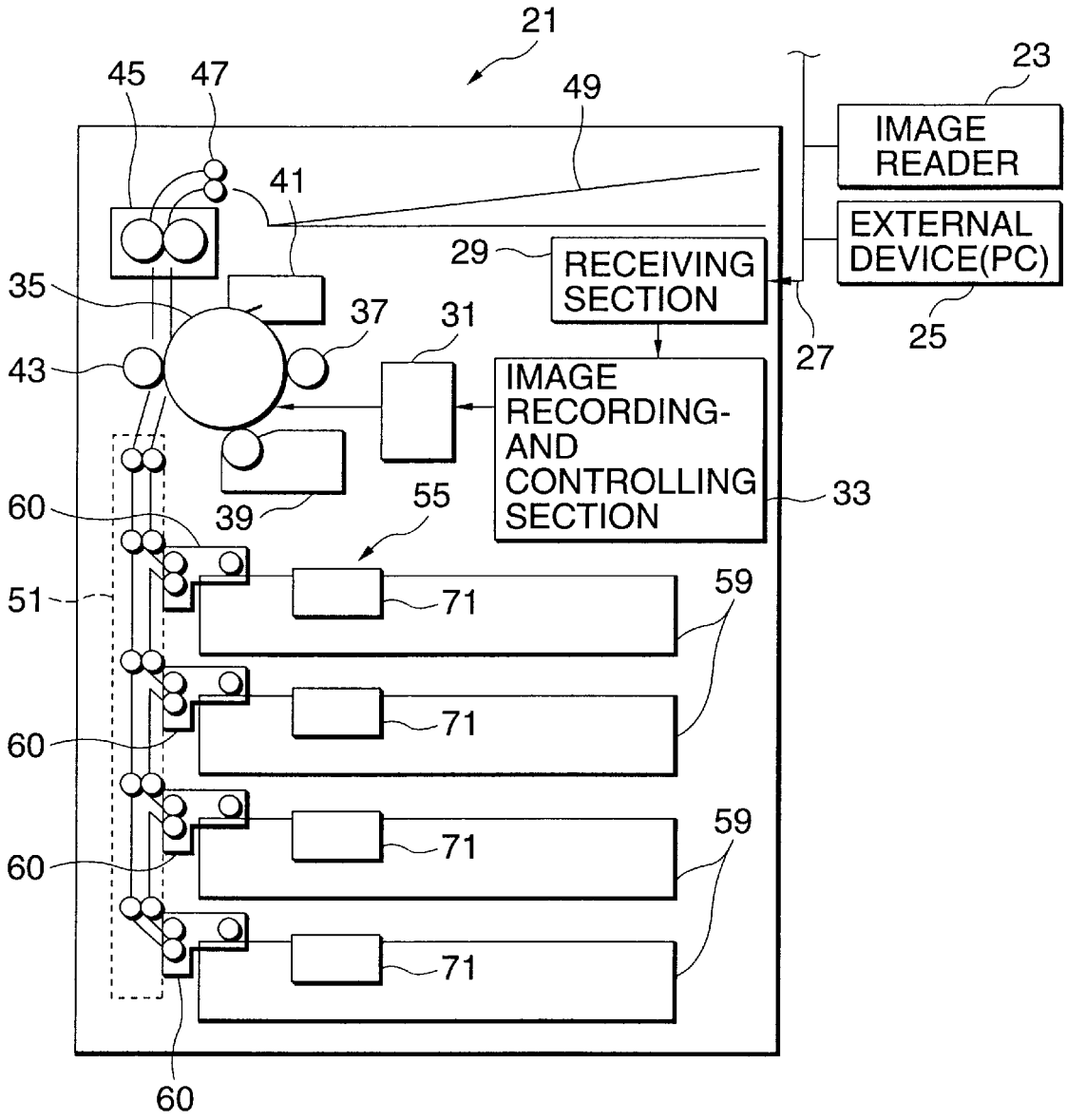
FIG. 1 is a side view schematically showing the structure of an image forming apparatus according to the present invention.
Figure 2:
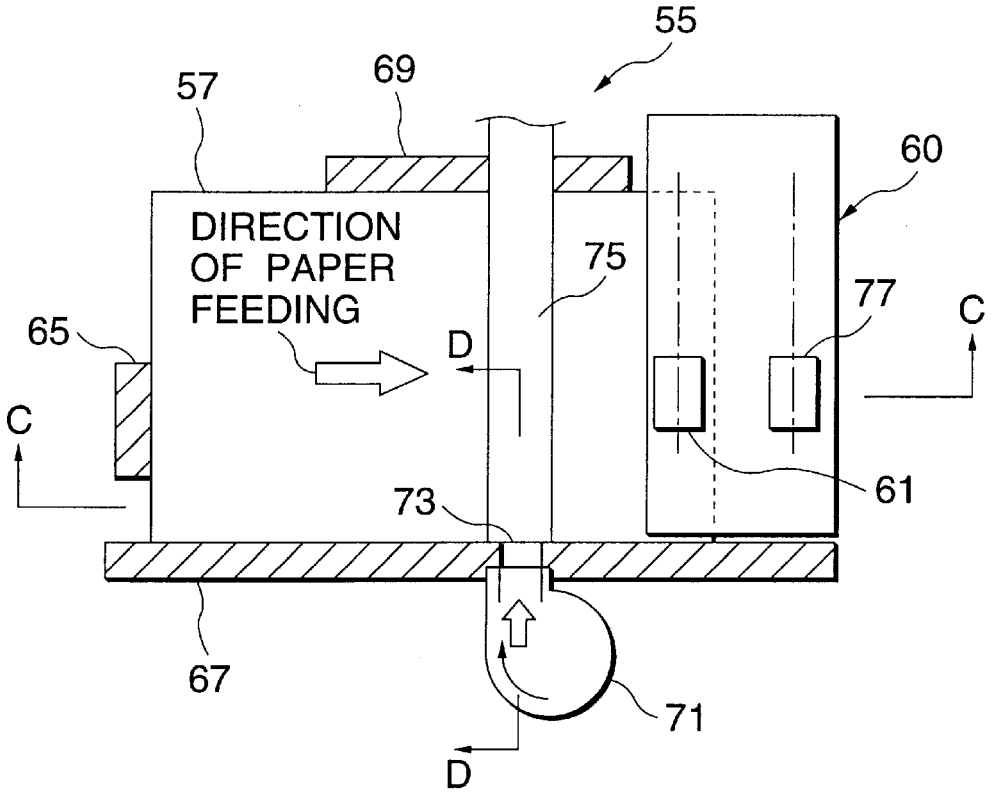
FIG. 2 is a plan view showing a paper feeder shown in FIG. 1.
Figure 3:
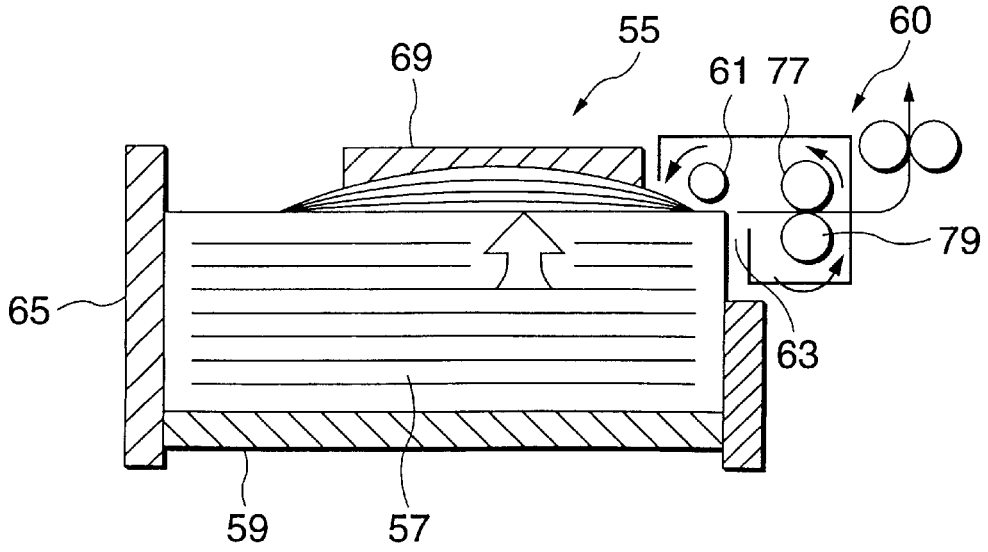
FIG. 3 is a cross-sectional view taken across line C—C shown in FIG. 2.
Figure 4:
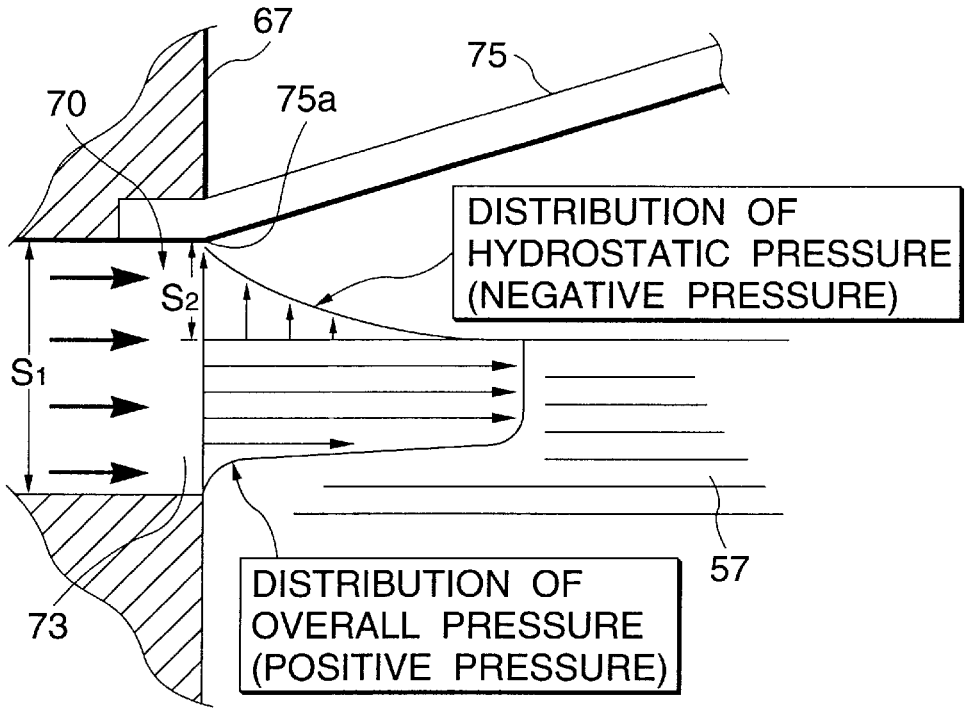
FIG. 4 is an enlarged view which shows an area in the vicinity of an air supply opening and which is taken across line D—D shown in FIG. 2.

FIG. 1 is a side view schematically showing the structure of an image forming apparatus according to the present invention; FIG. 2 is a plan view showing a paper feeder shown in FIG. 1; FIG. 3 is a cross-sectional view taken across line C—C shown in FIG. 2; and FIG. 4 is an enlarged view which shows an area surrounding an opening and which is taken across line D—D shown in FIG. 2.

An image forming apparatus 21 includes an image reader 23; an external device (e.g., a personal computer) 25; a receiving section 29 connected to the external device by way of a communications line 27; an image recording-and-controlling section 33 which controls an image writing device 31 on the basis of image data received from the receiving section 29; a cylindrical image carrier 35 onto which an electrostatic latent image is written by means of the image writing device 31; an electrostatic charger 37 disposed in the circumferential direction of an image carrier 35; a developer 39; a cleaner 41; a transfer roller 43 which transfers the image formed on the image carrier 35 to a sheet; a fixing device 45 which fixes the image transferred on the sheet; discharge rollers 47 which discharge the sheet 10 received from the fixing device 45; a discharge tray 49 which receives the sheets discharged from the discharge rollers 47;

and paper feeders 55, each of which feeds a sheet to between the image carrier 35 and the transfer roller 43 by way of a sheet carrier section 51.

As shown in FIG. 2, the paper feeder 55 is provided with a paper feed tray 59 on which sheets 57 are loaded, and the paper feed tray 59 has an unillustrated bottom plate which is raised or lowered by driving action of an unillustrated motor. Paper feed device 60 is provided above the paper feed tray 59.

A pick-up roller 61 is pivotally attached to the paper feed device 60 by way of unillustrated support arms, causing pivotal action upon contact with the upper surface of the sheet 57 raised. An unillustrated height sensor is disposed in the vicinity of the support arms and is arranged so as to be able to detect the height of the sheets 57 by detection of pivotal action of the support arms.

A movable end guide 65 is provided at one end of the paper feed tray 59, and a paper feed opening 63 is formed at the other end of the paper feed tray 59 so as to become opposite to the movable end guide 65. The movable end guide 65 evens up the edges of the sheets 57 loaded on the paper feed tray 59 in the direction opposite to the direction in which paper is fed. A stationary side guide 67 for evening up the side edges of the sheets 57 is provided on one side of the paper feed tray 59, and a movable side guide 69 is provided on the other side of the paper feed tray 59 so as to become movable according to a sheet size and opposite to the stationary side guide 67 while the paper feed opening 63 is interposed between the guides.

An air supply opening 73 of air blowing device 71 is formed in the stationary side guide 67 so as to become opposite to the side edges of the sheets 57 loaded on the paper feed tray 59. High-pressure air is supplied to the air supply opening 73 from the air blowing device 71. As shown in FIG. 4, the air supply opening 73 has the lower end located below the topmost sheet 57 and the upper end located above the topmost sheet 57. As a result of the positional relationship between the air supply opening 73 and the sheet 57 being set in such a manner, a passage S, through which air is supplied to the air supply opening 73 is narrowed down to a supply opening S2 which is formed between the upper end of the air supply opening 73 and the topmost sheet 57 and which has a cross-sectional area smaller than that of the passage $S_1$. As a result of formation of an air-passage narrowing section 70 having a smaller cross-sectional area, a negative pressure area is formed around the exit of the supply opening $S_2$ of the air supply opening 73.

Although air is blown toward the front side-edges of the sheets 57 in the first embodiment, air may be blown in any one of the four directions: that is, the front, rear, right, and left sides of the sheets 57. The air supply opening 73 may be formed so as to cover part of the side edges of the sheets or may be formed over the entire side edges of the same. Further, one or a plurality of air supply opening(s) 73 may be formed.

An air flow regulation member 75 is provided at the upper end of the air supply opening 73. The inclined air flow regulation member 75 is attached to the upper end of the air supply opening 73 at a leading end 75a thereof and extends at an angle in such a way as to become gradually apart from the upper surface of the sheet toward the center of the upper surface of the sheet. The air flow regulation member 75 permits a gradual increase in the cross-sectional area of passage of air from the air supply opening 73 toward the side guide 69, thereby forming a distribution of hydrostatic pressure such as that shown in FIG. 4 in which the greatest negative pressure area is formed above the edge the sheet.

In short, the air flow regulation member 75 is designed so as to be able to optimally control a distribution of hydrostatic pressure for the purpose of exerting lift on the sheet 57. With a view to efficiently converting blown air into lift, it is desirable to form the air flow regulation member 75 so as to have a width greater than that of the air supply opening 73.

Next, procedures of a paper feed method for the image forming apparatus having the foregoing construction will be described.

When the paper feed tray 59 having the sheets 57 loaded thereon is raised by being driven by a motor, the topmost sheet 57 comes into contact with the pick-up roller 61 situated in a standby position above the sheets 57. The motor is stopped in response to a detection signal output from the height sensor, so that the paper feed tray 59 is stopped at a given height.

Further, according to paper feeding command, when paper feeding is commenced, the air blowing device is driven, so that high-pressure air is blown from the air supply opening.

Subsequently, dynamic pressure is applied to side edges of the sheets 57, and hydrostatic pressure (i.e., negative pressure) having a distribution such as that shown in FIG. 4 is applied to an area above the edge of the sheet by means of the air-passage narrowing section 70 and the air flow regulation member 75. Lift stemming from the negative pressure acts on the sheets 57 in cooperation with the air blown into the space between the sheet raised by the lift and the remaining sheets, so as to release the attracting force, the sheets 57 are separated one by one.

The pick-up roller 61 pressed by means of an unillustrated solenoid comes into contact with the thus-separated sheet 57, commencing conveyance of the sheet. At the time of a paper-feeding operation, air may be blown to the sheets at all times or in an intermittent manner.

A paper feed roller 77 which rotates in the direction of paper feeding is situated downstream from the pick-up roller 61 and is in contact with a frictional roller 79 with a predetermined pressure. The frictional roller 79 is capable of bidirectionally rotating and receives torque from an unillustrated torque limiter within certain limits in the direction opposite to the direction of paper feeding. By virtue of the interaction between the paper feed roller 77 and the frictional roller 79, the sheets 57 that have not been separated by air are separated once again.

The height of the topmost sheet 57 becomes gradually lower as the sheets are fed, lowering the position of the pick-up roller 61. As a result, the support arms of the pick-up roller 61 actuate the height sensor so as to raise the paper feed tray 59 having a few papers. In this way, a paper feeding operation is continued. Through repetition of the foregoing operations, all of the sheets 57 loaded in the paper feed tray 59 are fed.

As mentioned previously, according to the foregoing paper feeding method, high-pressure air is blown toward the side edges of the sheets 57 from the air blowing device 71 in the air-passage narrowing section 70, and the thus-blown air is gradually released in the area above the upper surface of the sheet 57. Consequently, the maximum negative pressure can be produced in the area above the side edge of the sheet. The sheets 57 can be separated by means of lift stemming from the negative pressure in cooperation of dynamic pressure applied to the side edges of the sheets. As a result, the sheets 57 can be reliably separated with a small volume of air supply.

Further, since lift develops in the area above the upper surface of the sheet, a sheet-separation force can be ensured which is greater than that produced by application of only dynamic pressure to side edges of sheets according to the existing method, ensuring separation of the burred sheets 57 without fail.

The foregoing image forming apparatus 21 is provided with the air supply opening 73 for blowing air toward the sheets 57 and the air-passage narrowing section 70 for narrowing down the air flow blown from the air supply opening 73 with respect to the air flow supplied from the air supply passage. The air-passage narrowing section 70 enables a negative-pressure area to be formed in the area above the side edge of the sheet. The lift stemming from the negative pressure and the dynamic pressure applied to the side edges of the sheets can be exerted on the sheets at one time. As a result, a great force to separate sheets can be produced with a simple structure, resulting in a noise-reduction and compact image forming apparatus and a reduction in the cost of products and running costs.

Figure 5:
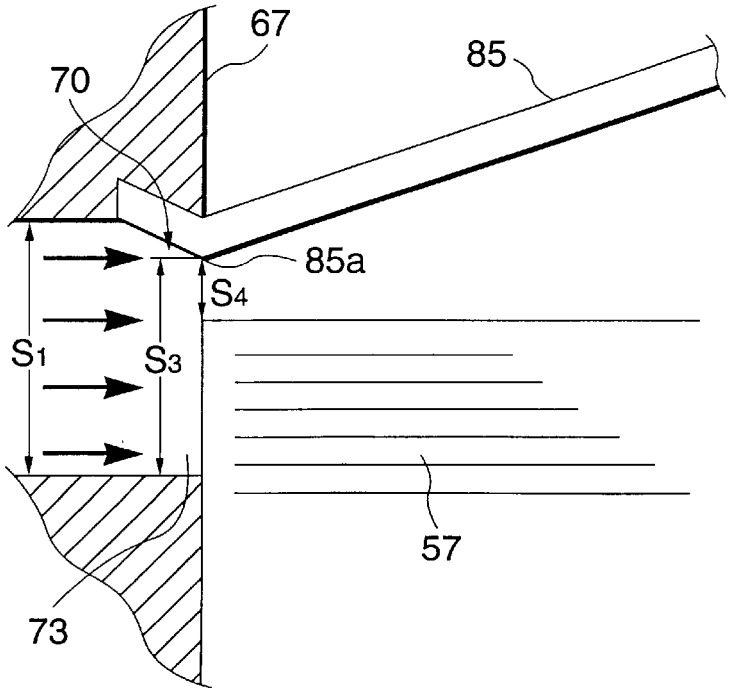
FIG. 5 is an enlarged view showing an area in the vicinity of an air supply opening according to a second embodiment.

An image forming apparatus according to a second embodiment of the present invention will now be described. FIG. 5 is an enlarged view showing an area in the vicinity of the air supply opening according to the second embodiment.

According to the second embodiment, an inclined air flow regulation member 85 is formed in such a way that a leading end 85*a* of the air flow regulation member 85 is situated at a position closer to the upper surface of the sheet when compared with the upper end of the air supply opening 73. The passage $S_1$ through which air is supplied to the air supply opening 73 is narrowed down to a passage $S_3$ having a cross-sectional area smaller than that of the passage $S_1$ at the position of the leading end 85*a*. The thus-narrowed passage $S_3$ is further narrowed down to a supply opening $S_4$ which is formed between the leading end 85*a* and the topmost sheet 57 and has a cross-sectional area much smaller than that of the passage $S_3$ in the air-passage narrowing section 70. In other respects, the image forming apparatus is the same in structure as that previously described for the first embodiment.

In the image forming apparatus according to the second embodiment, the leading end 85*a* of the air flow regulation member 85 is situated at a position closer to the upper surface of the sheet when compared with the upper end of the air supply opening 73. Accordingly, the air-passage narrowing section 70 can be formed by means of the air flow regulation member 85, as well as by means of the air-passage narrowing section 70 formed by the positional relationship between the air supply opening 73 and the sheets 57 in the first embodiment. Contrasted with the air-passage narrowing section formed from only the foregoing air-passage narrowing section 70, the air flow regulation member 85 according to the second embodiment can increase the ratio at which the cross-sectional area of the flow passage is reduced, enabling generation of greater lift. Further, since the air-passage narrowing section according to the second embodiment can be formed without reference to the positional relationship between the air supply opening 73 and the sheets 57, a negative-pressure area can be produced in an area above the edge of the sheet 57, e.g., even when the lower end of the air supply opening 73 is flush with the upper surface of the topmost sheet 57.

Figure 6A:
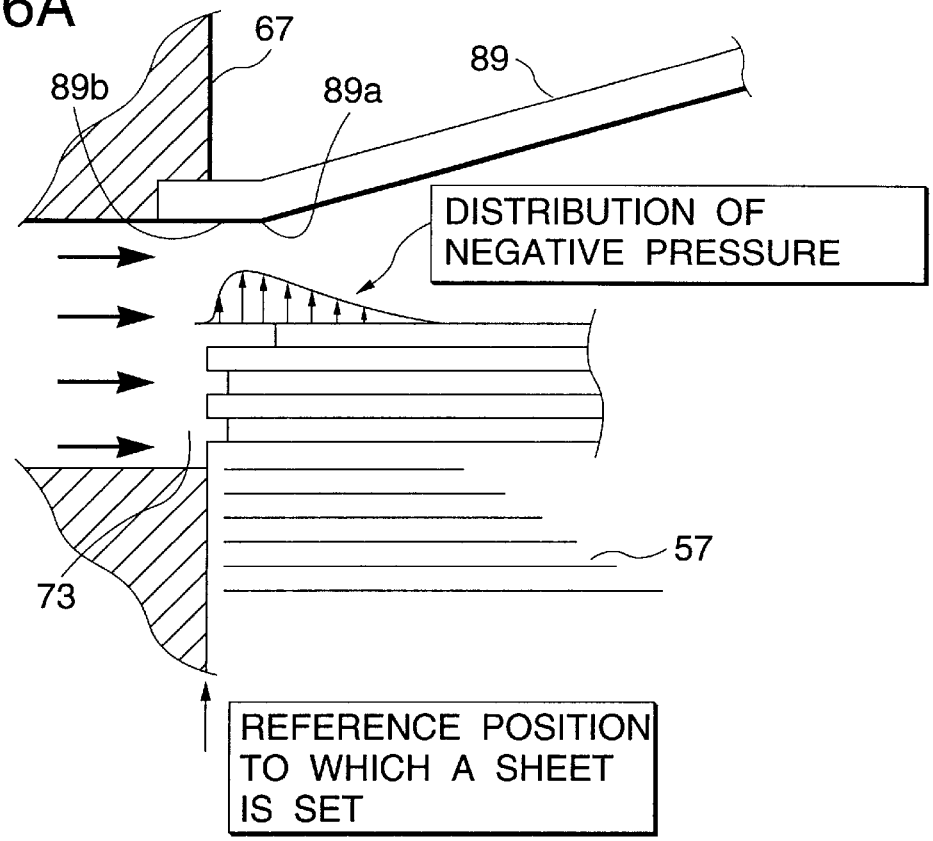
FIGS. 6A and 6B are enlarged views showing an area in the vicinity of an air supply opening according to a third embodiment.
Figure 6B:
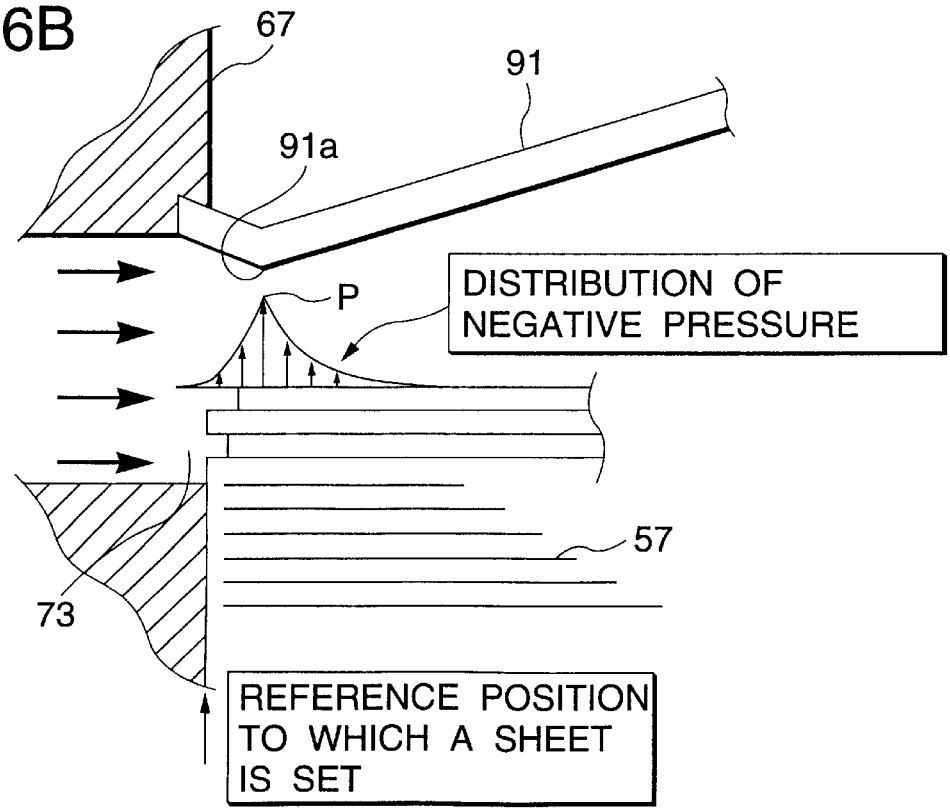
Figure 7A:
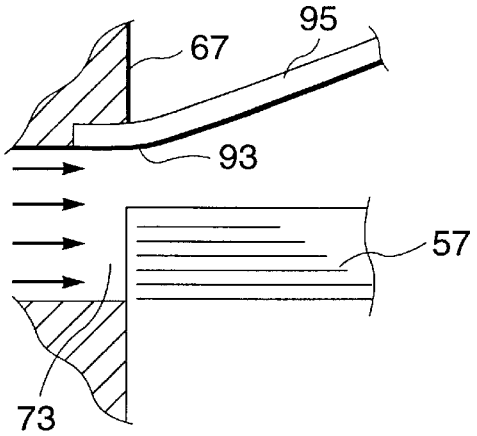
FIGS. 7A to 7D are enlarged views showing an area in the-vicinity of an air supply opening according to a fourth embodiment.
Figure 7B:
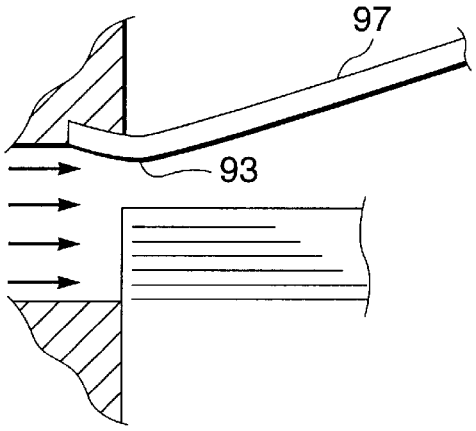
Figure 7C:
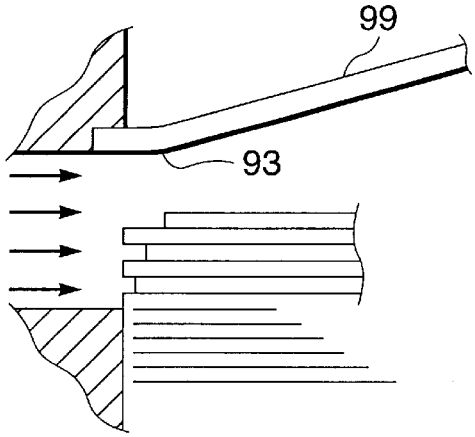
Figure 7D:
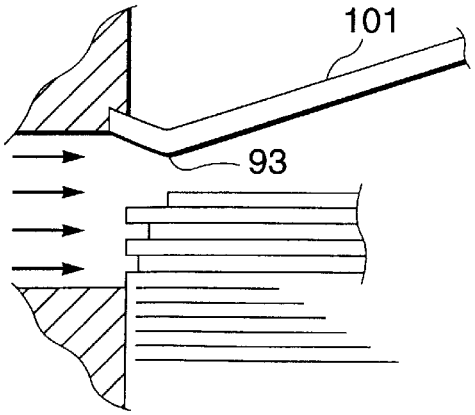

An image forming apparatus according to a third embodiment of the present invention will be described. FIGS. 6A and 6B are enlarged views showing an area in the vicinity of an air supply opening according to the third embodiment.

According to the third embodiment, an air flow regulation member 89 (shown in FIG. 6A) is formed by placing the leading end 75*a* of the air flow regulation member 75 shown in FIG. 4 in a position closer to the center of the sheet 57 relative to the side edge of the sheet 57 (i.e., the reference position at which sheets are set). Further, an air flow regulation member 91 (shown in FIG. 6B) is formed by placing the leading end 85*a* of the air flow regulation member 85 shown in FIG. 5 in a position closer to the center of the sheet 57 relative to the side edge of the sheet 57. In the air flow regulation member 89 shown in FIG. 6A, a plane 89*b* which is substantially parallel to the upper surface of the sheet is formed between the upper end of the air supply opening 73 and the leading end 89*a* of the inclined air flow regulation member 89. In other respects, the image forming apparatus are the same in structure as those previously described for the first and second embodiments.

In the image forming apparatus using the air flow regulation member 89 shown in FIG. 6A, the leading end 89*a* is placed in a position close to the center of the sheet 57, and there is provided the plane 89*b* which is substantially parallel to the upper surface of the sheet. Accordingly, a wide flat portion can be formed in a distribution curve of negative pressure. Even in a case where the edges of sheets are in a ragged state such as that shown in FIG. 6A and are misaligned in a moving-away direction relative to the air supply port, lift can be exerted on the edge of the sheet without fail.

Further, in the image forming apparatus using the air flow regulation member 91 shown in FIG. 6B, the leading end 91*a* is placed in a position closer to the upper surface of the sheet when compared to the upper end of the air supply opening 73, and the leading end 91*a* is placed in a position closer to the center of the sheet 57. Accordingly, the peak "p" where the maximum negative pressure develops can be situated at a position closer to the center of the sheet 57 than to the edge of the sheet. Even in this case, lift can be applied to the side edges of the sheets in a ragged state without fail.

An image forming apparatus according to a fourth embodiment of the present invention will be described. FIGS. 7A to 7D are enlarged views, each showing an area in the vicinity of an air supply opening according to the fourth embodiment.

According to the fourth embodiments, air flow regulation members 95, 97, 99, and 101 are formed by machining the leading positions of the air flow regulation members 75, 85, 89, and 91 shown in FIGS. 4 to 6: that is, the leading ends 75*a*, 85*a*, 89*a*, and 91*a*, so as to respectively have a continually-curved surface 93. In other respects, the image forming apparatus according to the fourth embodiment are the same in structure as those previously described for the first embodiment.

The air blown from the air supply opening 73 flows along the air flow regulation member. If the leading end of the air flow regulation member has a corner formed from two planes which are joined together at an angle, air diverges from the air flow regulation member, causing a whirling vortex around the leading end in a downstream direction. The thus-formed vortex results in an energy loss and a drop in negative pressure.

According to the fourth embodiment, the inclined leading ends of the air flow regulation members 95, 97, 99, and 101 are formed from the curved surface 93, mitigating occurrence of a vortex, which in turn reduces an energy loss. Accordingly, the lift developing above the upper surface of the sheet can be fully utilized.

Figure 8:
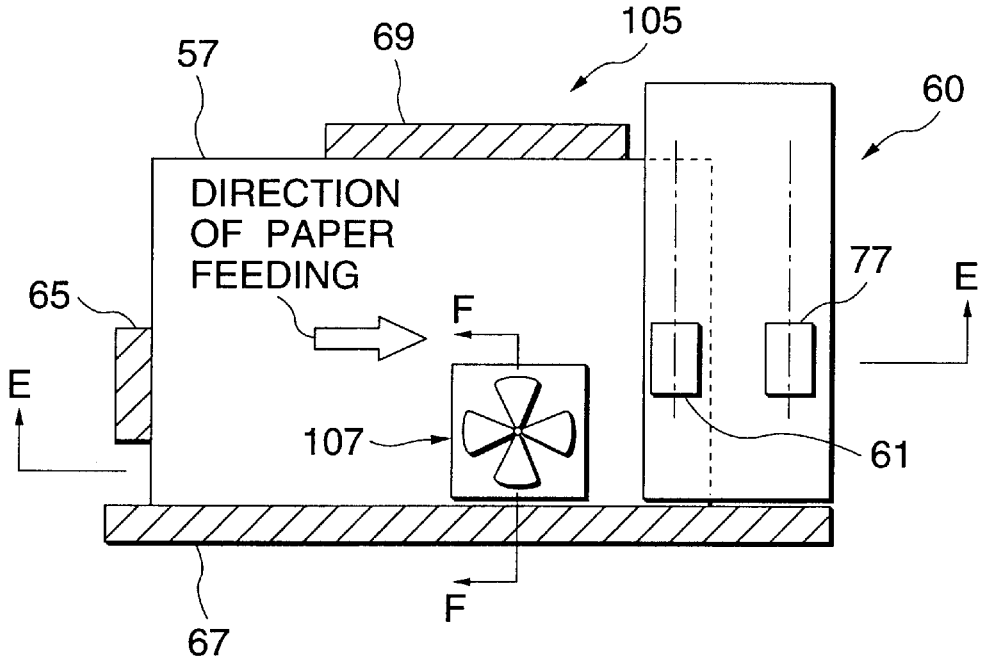
FIG. 8 is a plan view showing a paper feeder according to a fifth embodiment.
Figure 9:
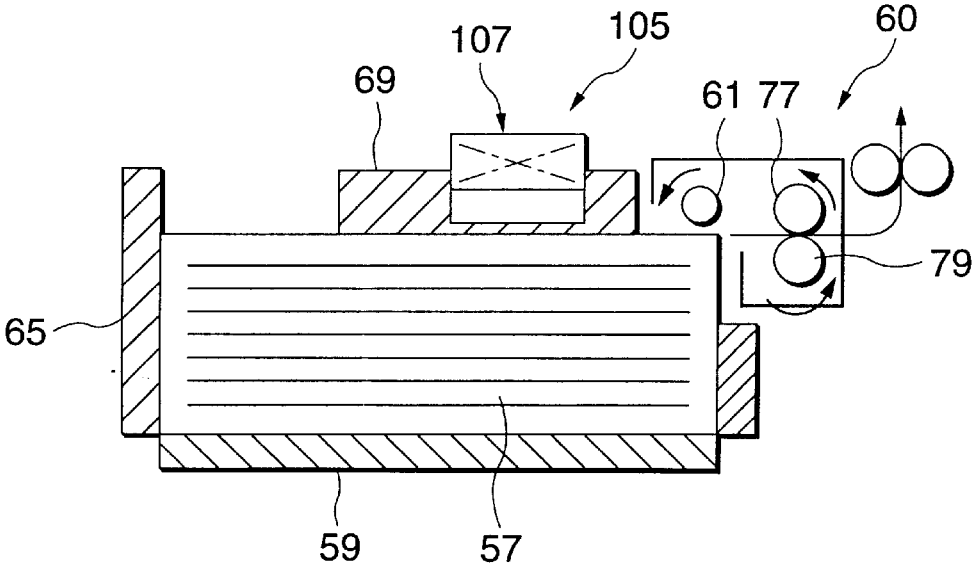
FIG. 9 is a cross-sectional view taken across line E—E shown in FIG. 8.
Figure 10:
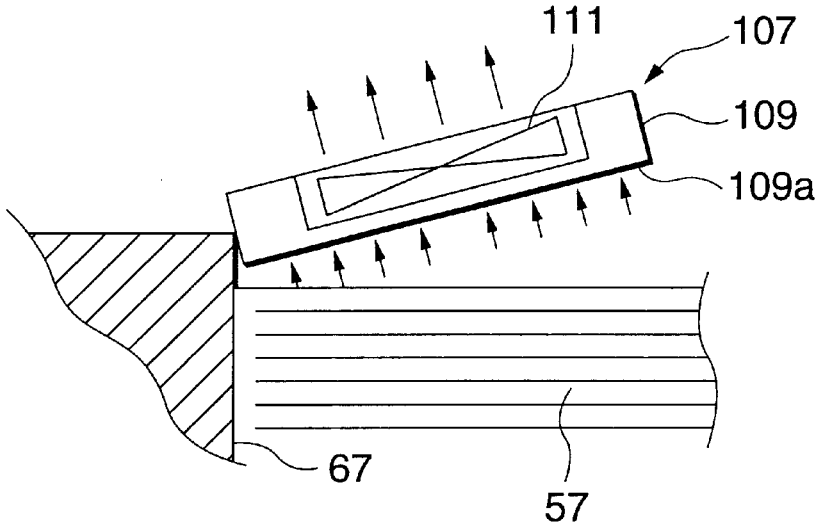
FIG. 10 is an enlarged view which shows an area in the vicinity of an air supply opening and which is taken across line F—F shown in FIG. 8.

An image forming apparatus according to a fifth embodiment of the present invention will now be described. FIG. 8 is a plan view showing a paper feeder showing a fifth embodiment of the present invention. FIG. 9 is a cross-sectional view taken across line E—E shown in FIG. 8, and FIG. 10 is an enlarged view which is taken across line F—F shown in FIG. 8 and which shows an area in the vicinity of an air supply opening.

A paper feeder 105 of the image forming apparatus according to the fifth embodiment is provided with air drawing device 107 which is disposed above sheets in lieu of the air supply opening 73 and the air flow regulation member 75 mentioned previously. In other respects, the image forming apparatus according to the fifth embodiment is the same in structure as that previously described for the first embodiment.

The air drawing device 107 includes the vacuum chamber 109 and an axial-flow fan 111 provided within the vacuum chamber 109.

A plurality of unillustrated vacuum holes are formed in a flat lower surface (or a drawing surface) 109*a* of the vacuum chamber 109. Air between the upper surface of the sheet and the lower surface 109*a* is drawn into the vacuum chamber 109 through the vacuum holes by actuation of the axial-flow fan 111. The vacuum chamber 109 is disposed at an angle in such a way that the end of the vacuum chamber fixed to the side edge 67 is located in a lower position than that of the free end of the same opposite to the fixed end. Accordingly, the air drawing device 107 is capable of forming greater negative pressure in the area above the end of the sheet than that produced in the area above the center of the sheet.

In the foregoing image forming apparatus, since the air drawing device 107 is disposed in such way that the drawing surface of the vacuum chamber 109 becomes closest to the upper surface of the sheet in the vicinity of the side edge of the sheet. Accordingly, the maximum lift can be ensured in the vicinity of the side edge of the sheet, enabling drawing force to be efficiently used for separating the sheets 57.

Although air is not blown toward the side edges of the sheets in the fifth embodiment, air may be additionally blown toward the side edges of the sheets. Further, a scirocco fan or another air drawing device may be provided in place of the axial-flow fan 111.

Figure 11:
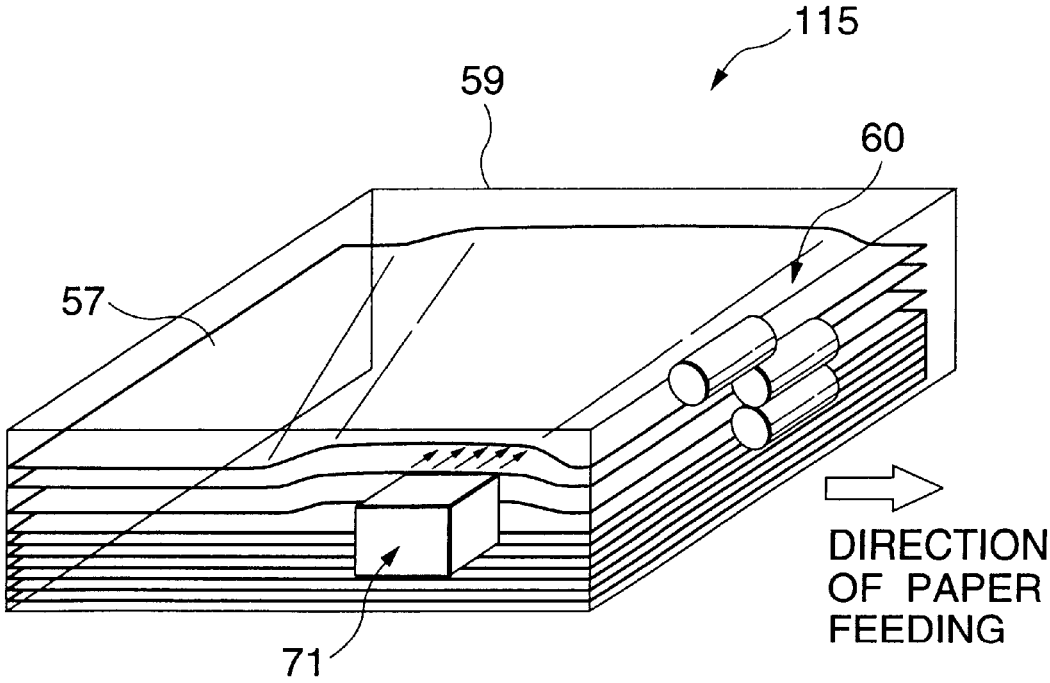
FIG. 11 is a perspective view showing the configuration of a paper feeder on which an image forming apparatus according to a sixth embodiment is based.
Figure 12:
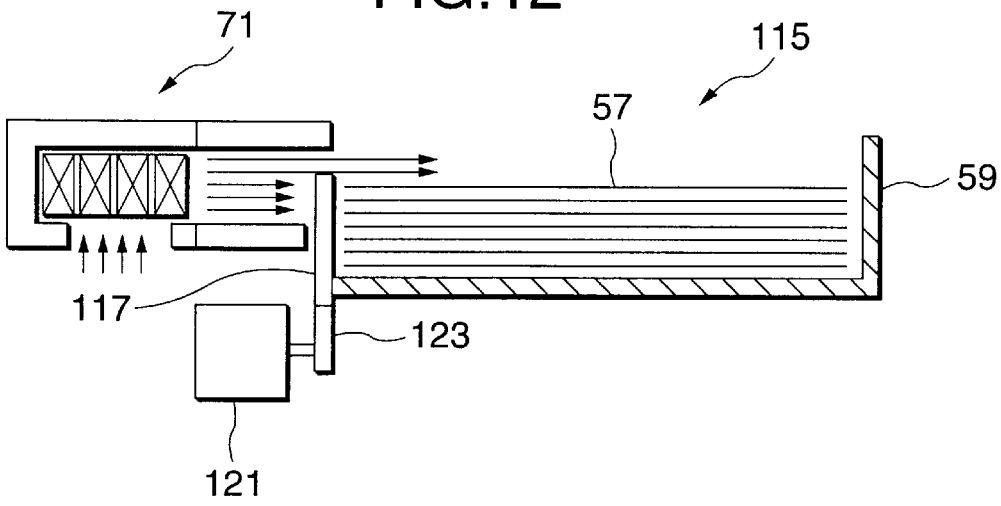
FIG. 12 is a cross-sectional view showing the paper feeder according to the sixth embodiment.
Figure 13A:
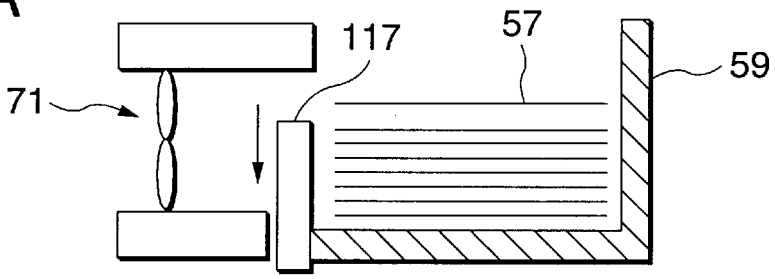
FIGS. 13A to 13C are cross-sectional views which show the principal elements and which explain the operation of the image forming apparatus according to the sixth embodiment.
Figure 13B:
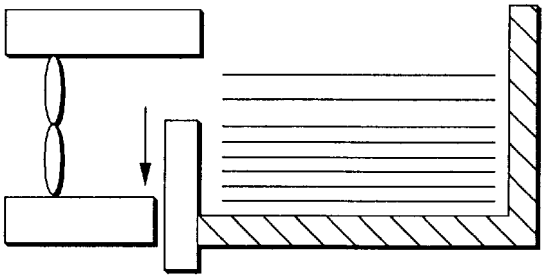
Figure 13C:
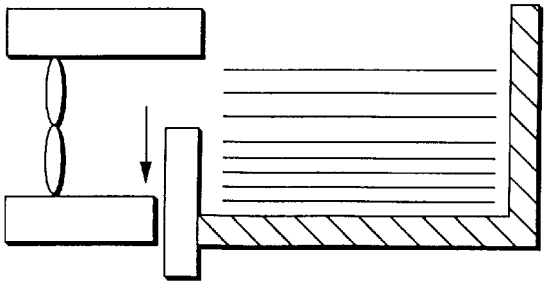
Figure 14:
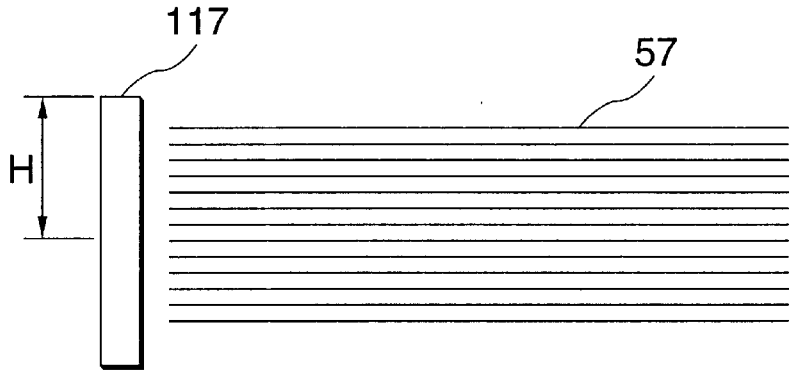
FIG. 14 is an explanatory view showing the extent to which air interruption device is actuated.

An image forming apparatus according to a sixth embodiment of the present invention will now be described. FIG. 11 is a perspective view showing the configuration of a paper feeder on which the image forming apparatus according to the sixth embodiment is based. FIG. 12 is a cross-sectional view showing the paper feeder according to the sixth embodiment, and FIGS. 13A to 13C are cross-sectional views showing the operations of the principal elements of the paper feeder according to the sixth embodiment. FIG. 14 is an explanatory view showing the extent to which air interruption device is actuated.

A paper feeder 115 of the image forming apparatus according to the sixth embodiment comprises a paper feed tray 59 on which the sheets 57 are loaded; paper feed device 60 which feeds a sheet from the paper feed tray 59; air blowing device 71 for blowing air toward the side edges and upper surface of the loaded sheets 57 in the direction at right angles to the side edges of the-sheets 57; and air interruption device 117 which is air-passage moving device.

The paper feed tray 59 may be any one of an elevator type, a tilt type, a spring-loaded lifting type, and a stationary type.

The paper feed device 60 may be any one of a retard roller type, a separating pawl type, and a vacuum feed type.

Further, the air blowing device 71 is any one of an axial-flow type and a scirocco type. Air may be blown in any one of longitudinal and lateral directions of the sheet 57.

The paper feeder 115 includes an electric motor 121 and a cam plate 123 which comes into frictional contact with the lower end surface of the air interruption device 117 and is fixed to the output shaft of the electric motor 121. The air interruption device 117 is interposed between the air blowing device 71 and the side edges of the sheets 57 in parallel with the side edges of the sheets 57. The air interruption device 117 is supported so as to be freely slidable in a direction perpendicular to the surface of the sheet by means of unillustrated guide rail or the like.

The operation of the image forming apparatus having the foregoing structure will be described.

When the paper feeder 115 is in an inactive state, the upper end of the air interruption device 117 is situated above the topmost sheet 57 (FIG. 12). When the electric motor 121 is activated to rotate the cam plate 123, as shown in FIGS. 13A to 13C the air interruption device 117 is downwardly moved in accordance with the tooth formed along the edge of the cam plate 123. As a result of downward movement of the air interruption device 117, the passage of the air blown from the air blowing device 71 is downwardly moved in the direction perpendicular to the surface of the sheet.

As mentioned previously, as a result of the passage of air being moved in the direction from top to bottom relative to the side edges of the sheets 57 in a manner such as that shown in FIGS. 13A to 13C, air flows through the sheets 57 in order from top to bottom, thus separating the sheets 57. Although the air interruption device 117 has the effect of separating the sheets solely by being moved once in the direction from top to bottom, the effect of separating the sheets is further improved by vertically actuating the air interruption device 117 back and forth.

If the air interruption device 117 is actuated too fast, there may arise a case where air is blown toward a sheet below the topmost sheet 57 before the topmost sheet blows off, resulting in the topmost sheet 57 remaining in contact with the lower sheets. To prevent this problem, it is desirable to set the speed at which the air interruption device 117 is actuated to a comparatively lower speed. For example, a traveling speed of 50 mm/sec. or less is preferable.

If the distance between-the air interruption device 117 and the sheets 57 is great, the air flow is spread, reducing the effect of separating sheets. For this reason, it is desirable to set the distance between the air interruption device 117 and the sheets 57 to be a comparatively short distance. For example, a desirable distance is 20 mm or less.

The air interruption device 117 must be actuated within a certain extent in the vertical direction. For example, if the upper limit of the movable extent of the air interruption device is lower than the topmost sheet 57, the sheet 57 located above the upper limit of the movable extent cannot be separated. In contrast, if the lower limit of the movable extent is higher than the topmost sheet 57, it goes without saying that the sheet 57 does not blow off. Accordingly, as shown in FIG. 14, extent H in which the air interruption device 117 is actuated is set in such a way that air passes by at least the topmost sheet 57.

The paper feeder 115 is provided with an unillustrated position sensor provided in the vicinity of the air interruption device 117. When there is no paper feeding operation, the air interruption device 117 is returned to a withdrawal position (i.e., a home position) in accordance with position detection information received from the position detection sensor.

In the image forming apparatus according to the sixth embodiment, the air interruption device 117 is actuated in the direction perpendicular to the surface of the sheet, thus moving the passage of air in the direction from top to bottom relative to the side edges of the sheets 57 in such a way that air passes by at least the topmost sheet, enabling blowing of the sheets 57 in order from top to bottom. Accordingly, it is possible to prevent separation of a group of upper sheets 57 along weakly-attached sheets, which would otherwise be caused by blowing air toward the side edges of the sheets 57 at one time. Consequently, all the sheets 57 can be separated without fail in order from top to bottom, preventing feeding failures or feeding of overlapped sheets.

Further, the use of the air interruption device 117 enables the passage of air to be moved in the direction perpendicular to the surface of the sheet with a simple structure.

Still further, since the distance between the air interruption device 117 and the sheets 57 is set to a given distance, air is prevented from being spread, enabling air to be blown toward the side edges of the sheets 57 at an optimum flow rate.

Figure 15A:
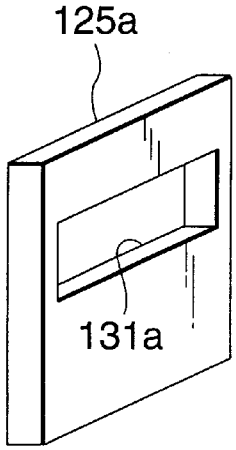
FIGS. 15A to 15C are explanatory views showing the shape of the air interruption device used in a seventh embodiment.
Figure 15B:
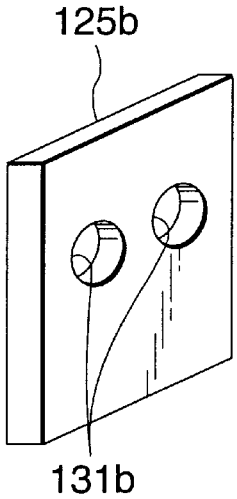
Figure 15C:
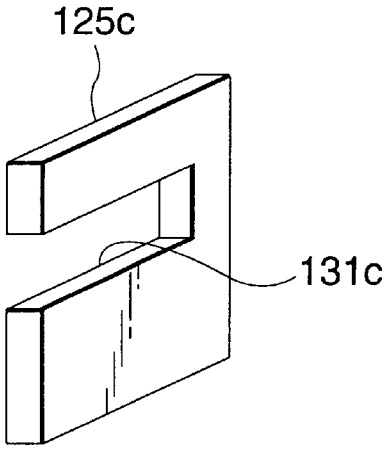

Next, an image forming apparatus according to a seventh embodiment of the present invention will be described. FIGS. 15A to 15C are explanatory views showing examples of the air interruption device used in the seventh embodiment.

An opening 131 is formed in an air interruption device 125 of the image forming apparatus according to the seventh embodiment.

A horizontally elongated rectangular opening 131*a* is formed in air interruption device 125*a* shown in FIG. 15A. A plurality of circular openings 131 are horizontally formed in air interruption device 125*b* shown in FIG. 15B. An opening 131*c* is made in the form of a notch in one side of air interruption device 125*c* shown in FIG. 15C.

The air blown from the air interruption device 125 having such an opening 131 is blown toward the side edges of the sheets via the opening 131. In such a case, the extent to which the air interruption device 125 is actuated is set in such a way that the lower end of the opening 131 passes by the topmost sheet.

If the vertical height of the opening 131 is narrow, the air interruption device 125 having the opening 131 is actuated at slow speed because of interference between air flows. In contrast, if the vertical height of the opening 131 is too wide, the effect of concentrating the air flow caused by narrowing the passage of air is decreased. Accordingly, it is desirable to set the vertical height of the opening 131 within a given extent. For example, a suitable height is in a range of about 1 to 10 mm.

In the paper feeder equipped with the air interruption device 125, air concentrates in the vicinity of the opening 131, thus increasing the flow rate of air and increasing lift used for causing the sheet 57 to blow off.

In the image forming apparatus according to the seventh embodiment, since the opening 131 is formed in the air interruption device 125, air can be blown toward the side edges of the sheets at a given flow rate at all times by permitting passage of air through the opening 131, and the passage of air can be vertically moved by actuation of the air interruption device 125.

Further, since the opening 131 is set to a given height, interference between air flows is prevented, enabling blowing of air toward the side edges of the sheets 57 at an optimum flow rate.

As is the case with the foregoing paper feeder 115, the paper feeder according to the seventh embodiment is capable of separating all the sheets 57 by blowing air toward the sheets 57 in order from top to bottom and by causing the sheet 57 to blow off without fail, preventing feeding failures and feeding of overlapped sheets. In addition, the air passing through the opening 131 is moved while the flow rate of the air is increased to a given flow rate at all times, the sheets 57 can be separated in a further reliable manner.

Figure 17:
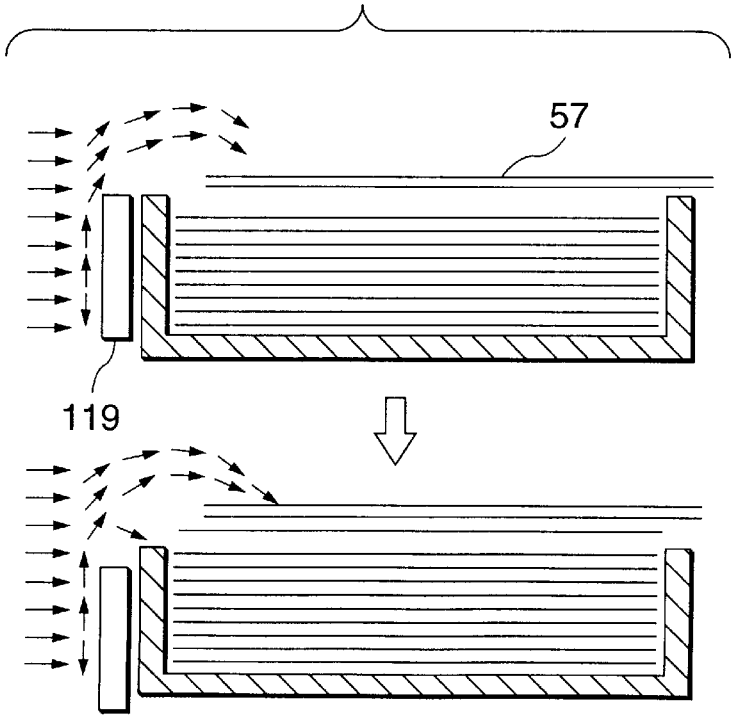
FIG. 17 is an explanatory view showing the flow of air when there is used air interruption device having no openings.
Figure 18:
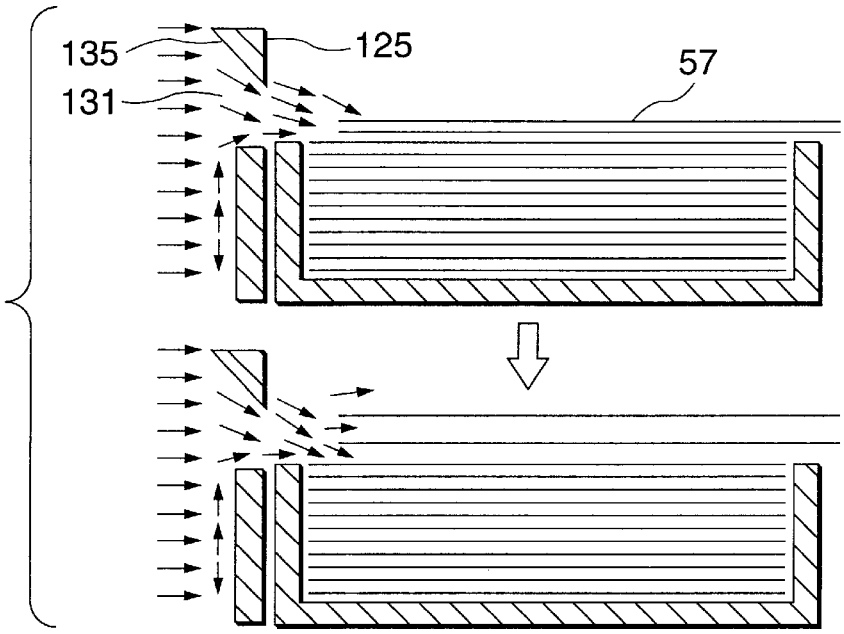
FIG. 18 is an explanatory view showing the flow of air when there is used the air interruption device described for the eighth embodiment.

Next, an image forming apparatus according to an eighth embodiment of the present invention will be described. FIGS. 16A to 16D are explanatory views showing examples of shape of the air interruption device used in the eighth embodiment. FIG. 17 is an explanatory view showing the flow of air when there is used air interruption device without holes, and FIG. 18 is an explanatory view showing the flow of air when there is used air interruption device according to the eighth embodiment.

In the image forming apparatus according to the eight embodiment, the internal peripheral ceiling of the opening 131 made in the air interruption device 125 is formed into a tapered surface 135. The tapered surface 135 has a gradual diminution of a distance between the ceiling and the upper surface of the sheet 57 in the direction in which air is blown (i.e., a downward gradient).

Figure 16A:
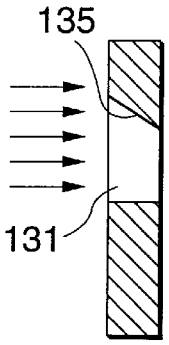
FIGS. 16A to 16D are explanatory views showing the shape of the air interruption device used in an eighth embodiment.
Figure 16B:
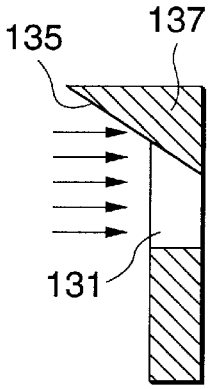
Figure 16C:
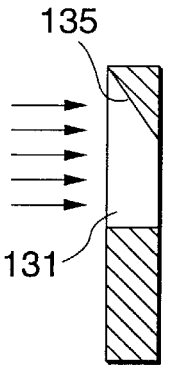
Figure 16D:
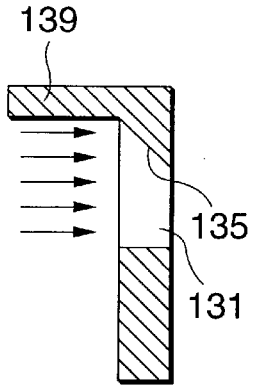

The opening 131 is formed so as to have: the simple tapered surface 135 such as that shown in FIG. 16A, wherein the tapered surface is formed along the internal peripheral ceiling of the opening 131; the tapered surface 135 such as that shown in FIG. 16B, wherein a thick portion 137 is made by increasing the thickness of an upper portion of the air interruption device 125 and the tapered surface 135 is formed so as to extend along the thick portion 137 toward unillustrated air blowing device; the tapered surface 135 such as that shown in FIG. 16C, wherein the air interruption device 125 has a constant thickness and the tapered surface is formed in such a way that the upper end of the tapered surface is in agreement with the upper end of the air interruption device 125; or the tapered surface 135 such as that shown in FIG. 16D, wherein a hood 139 is formed at the upper end of the tapered surface 135 in parallel with the flow of air.

As shown in FIG. 17, the air blown from unillustrated air blowing device comes into collision with air interruption device 119 having no openings 131, and part of the air flows in a vertical direction along the air interruption device 119. In such a case, if the upper sheet 57 is loaded in a ragged state, air is not blown toward the side edge of the sheet 57 in a ragged state, thus causing the sheet 57 below the raggedly-loaded sheet 57 to blow off while they are closely in contact with each other.

In contrast, since the image forming apparatus according to the eighth embodiment has the tapered surface 135 made by downwardly tapering the internal peripheral ceiling of the opening 131, the air blown from the air blowing device flows in a downward direction and comes into collision even with the side edge of the sheet 57 in such a ragged state as shown in FIG. 18.

In the image forming apparatus according to the eight embodiment, since the downwardly-tapered surface 135 is formed along the internal peripheral ceiling of the opening 131, the air blown from the opening 131 can be directed downward. As a result, even if the upper sheet 57 is in a ragged state, the air can be blown toward the side edge of the-sheet 57 in a ragged state, ensuring separation of the raggedly-loaded sheet 57 from a subsequent sheet 57 blow it.

It is desirable to set the gradient of the tapered surface 135 to a given angle. A suitable angle of about 60° with respect to the upper surface of the sheet.

Figure 19:
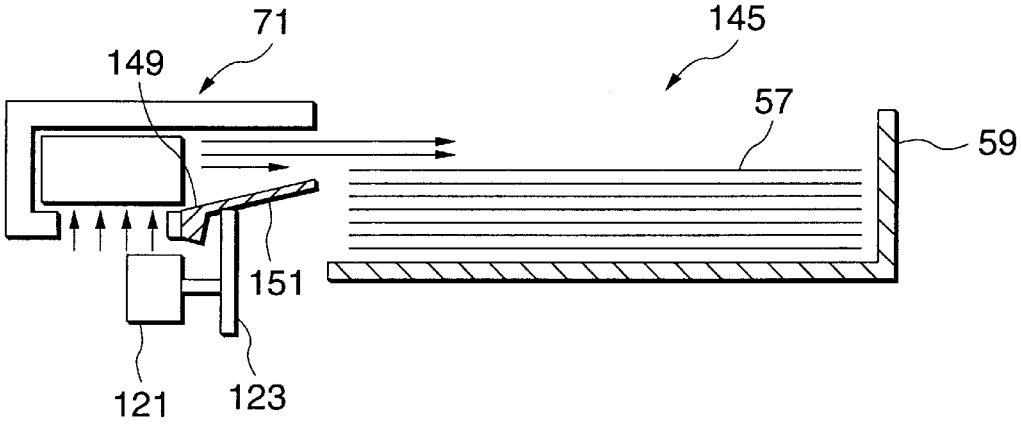
FIG. 19 is a cross-sectional view showing a paper feeder according to a nineteenth embodiment of the present invention.

Next, an image forming apparatus according to a ninth embodiment of the present invention will be described. FIG. 19 is a cross-sectional view showing a paper feeder according to the ninth embodiment.

A paper feeder 145 of the image forming apparatus according to ninth embodiment includes the paper feed tray 59 on which the sheets 57 are loaded; unillustrated paper feed device which feeds sheets from the paper feed tray 59; and the air blowing device 71 which blows air toward the side edges and upper surface of the sheets 57 in the direction perpendicular to the side edges of the sheets 57.

The paper feeder 145 includes a horizontal support shaft 149 provided in parallel with the side edges of the sheets 57; a pivotal plate 151 which serves as air-passage changing device, which is pivotally supported at the base end by the support shaft 149, and which has the leading end being opposite to the side edge of the sheet 57 and being vertically pivotal; an electric motor 121; and a cam plate 123 which is fixed to the output shaft of the electric motor 121 and comes into frictional contact with the lower surface of the pivotal plate 151.

In the paper feeder 145, when the electric motor 121 is activated, the cam plate 123 comes into frictional contact with the pivotal plate 151, causing the leading end of the pivotal plate 151 to vertically pivot with respect to the side edges of the sheets 57. As a result, the pivotal plate 151 moves the passage of air blown from the air blowing device 71 in the direction perpendicular to the surface of the sheet.

In the image forming apparatus according to the ninth embodiment, the passage of air is moved by pivotally actuating the pivotal plate 151 provided in the direction in which air flows, preventing a vortex, which would otherwise be caused by collision of air against the vertical air interruption device. Consequently, a pressure loss of air caused at the time of movement of the passage of air can be reduced.

Figure 20:
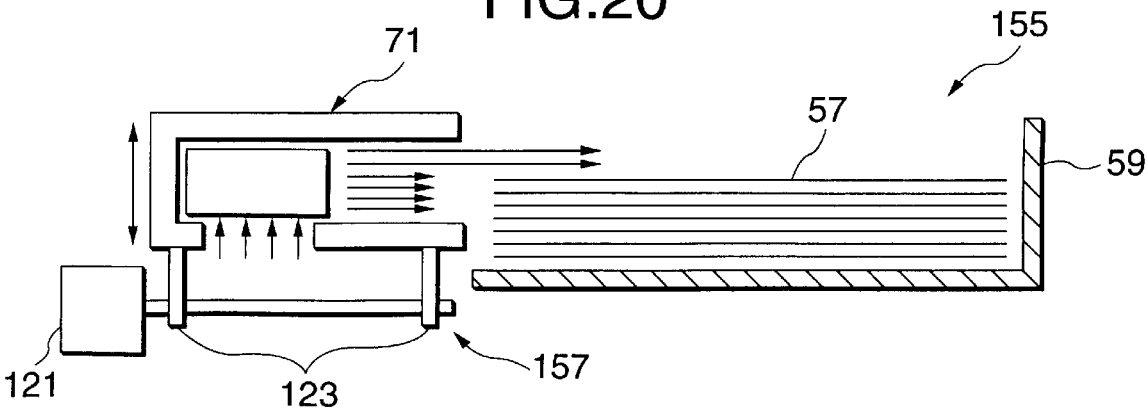
FIG. 20 is a cross-sectional view showing a paper feeder according to a tenth embodiment of the present invention.

An image forming apparatus according to a tenth embodiment of the present invention will now be described. FIG. 20 is a cross-sectional view showing a paper feeder used in the tenth embodiment.

A paper feeder 155 of the image forming apparatus according to the tenth embodiment includes the paper feed tray 59, unillustrated paper feed device; the air blowing device 71; and movable device 157 which serves as air-passage moving device.

The movable device 157 includes an unillustrated guide rail which supports the air blowing device 71 in a vertically movable manner; the electric motor 121; and the cam plate 123 which is connected to the output shaft of the electric motor 121 and comes into frictional contact with the lower surface of the air blowing device 71 to thereby actuate the air blowing device 71. Accordingly, when the cam plate 123 is rotated by rotation of the electric motor 121, the overall air blowing device 71 is actuated in a vertical direction.

In the paper feeder 155, the opening (i.e., the air supply opening) of the air blowing device 71 has a constant cross-sectional area, and air is moved in the direction perpendicular to the surface of the sheet with respect to the side edges of the sheets 57 by actuation of the overall air blowing device 71 in a vertical direction. Accordingly, the need for air interruption device used for changing the direction of air flow is eliminated.

The image forming apparatus according to the tenth embodiment enables the passage of air to be vertically moved without use of air interruption device. Further, at that time, the opening of the air blowing device 71 having a constant cross-sectional area is provided opposite the side edges of the sheets 57, thus forming the air-passage narrowing section which narrows the air flow blown from the opening by reducing the cross-sectional area of the opening. Consequently, all of the sheets 57 can be separated by causing the sheets 57 to blow off one at a time in order from top to bottom. As a result, feeding failures or feeding of overlapped sheets can be prevented.

Figure 21:
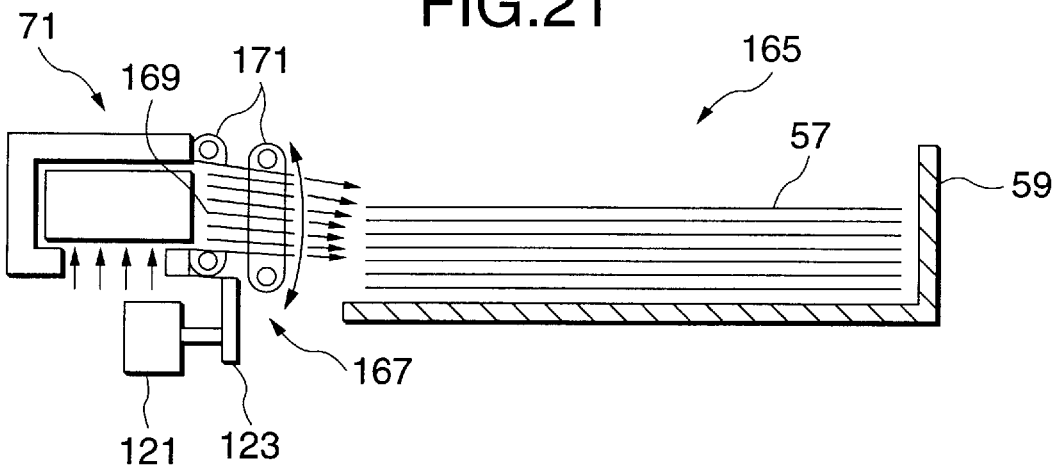
FIG. 21 is a cross-sectional view showing a paper feeder according to an eleventh embodiment of the present invention.

Next, an image forming apparatus according to an eleventh embodiment of the present invention will be described. FIG. 21 is a cross-sectional view showing a paper feeder according to the eleventh embodiment.

A paper feeder 165 of the image forming apparatus according to the eleventh embodiment includes the paper feed tray 59; unillustrated paper feed device; the air blowing device 71; and direction changing device 167 which serves as the air-passage changing device provided between the air 15blowing device 71 and the sheets 57.

The direction changing device 167 includes a plurality of rectifying vanes 169 provided with given pitches in parallel with one another in a vertical direction; an angle changing section 171 for changing the support angle of the rectifying vanes 169; the electric motor 121; and the cam plate 123 which is fixed to the output shaft of the electric motor 121 and which actuates the angle changing section 171.

In the paper feeder 165 of this type, when the electric motor 121 is activated to rotate the cam plate 123, the angle changing section 171 is driven, thus placing the rectifying vanes 169 in an angled position. Accordingly, the passage of the air blown from the air blowing device 71 is moved with respect to the side edges of the sheets 57 in the direction perpendicular to the-surface of the sheet.

In the foregoing image forming apparatus, air can be blown toward the sheets 57 in order from top to bottom, thus enabling separation of the sheets 57. Since air is blown toward the sheets while being rectified by means of the plurality of rectifying vanes 169, the passage of air can be changed without causing a vortex, thereby reducing the pressure loss of the air.

Figure 22A:
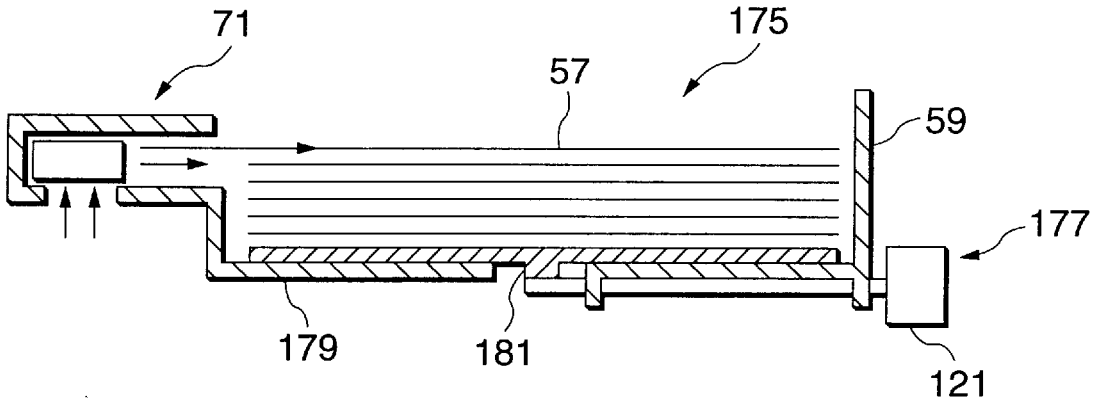
FIGS. 22A and 22B are cross-sectional views showing a paper feeder according to a twelfth embodiment of the present invention.
Figure 22B:
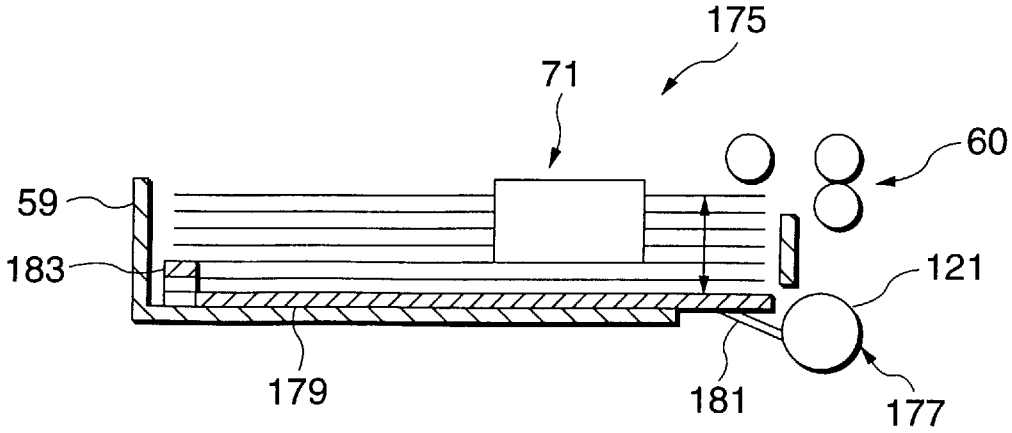
Figure 23:
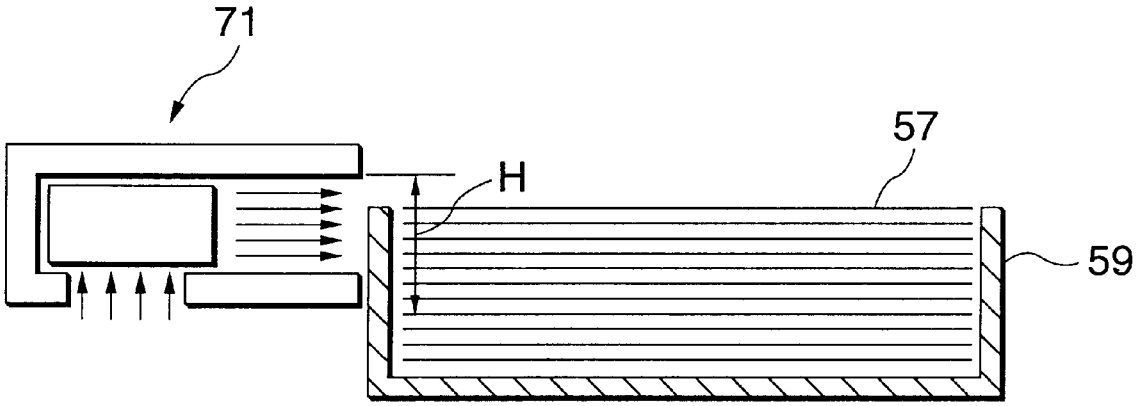
FIG. 23 is an explanatory view showing the extent to which sheets are raised or lowered according to the twelfth embodiment.
Figure 24:
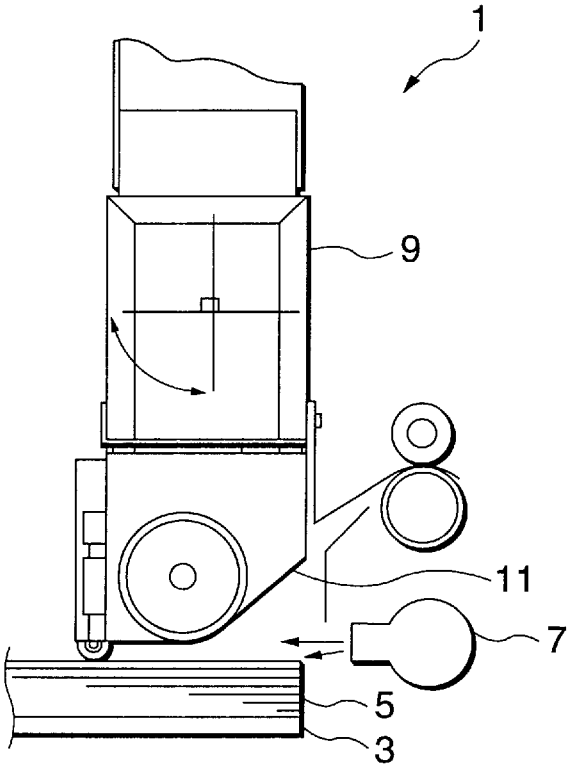
FIG. 24 is a view schematically showing the configuration of an existing paper feeding apparatus equipped with an air supply tube.
Figure 25:
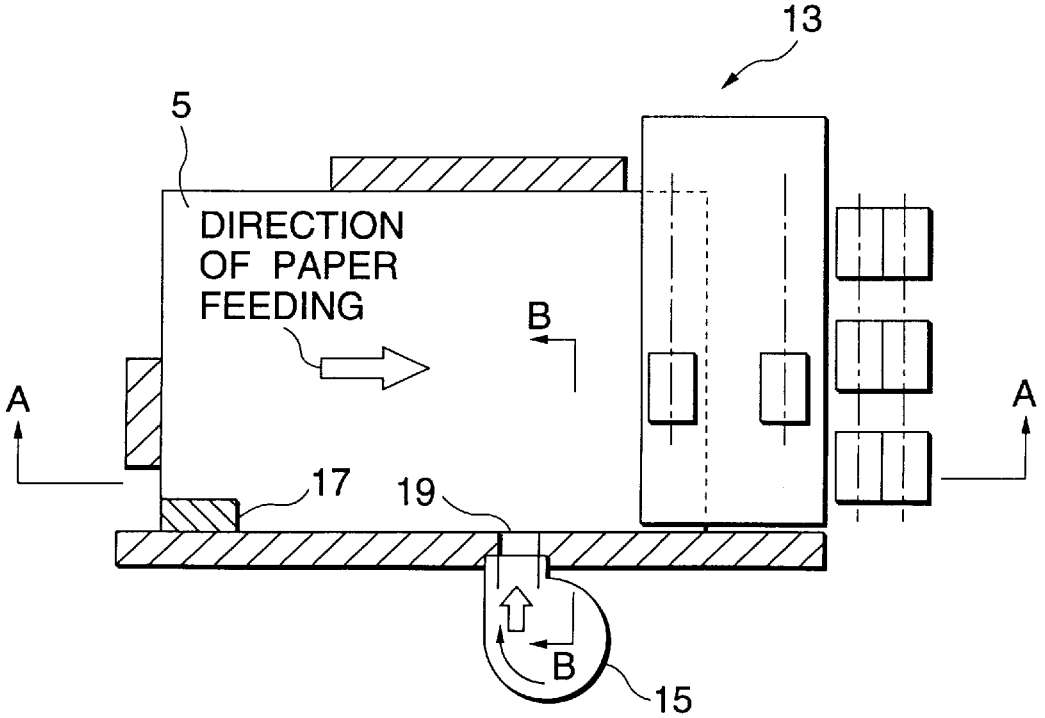
FIG. 25 is a plan view showing an existing paper feeder equipped with a sheet press member.
Figure 26:
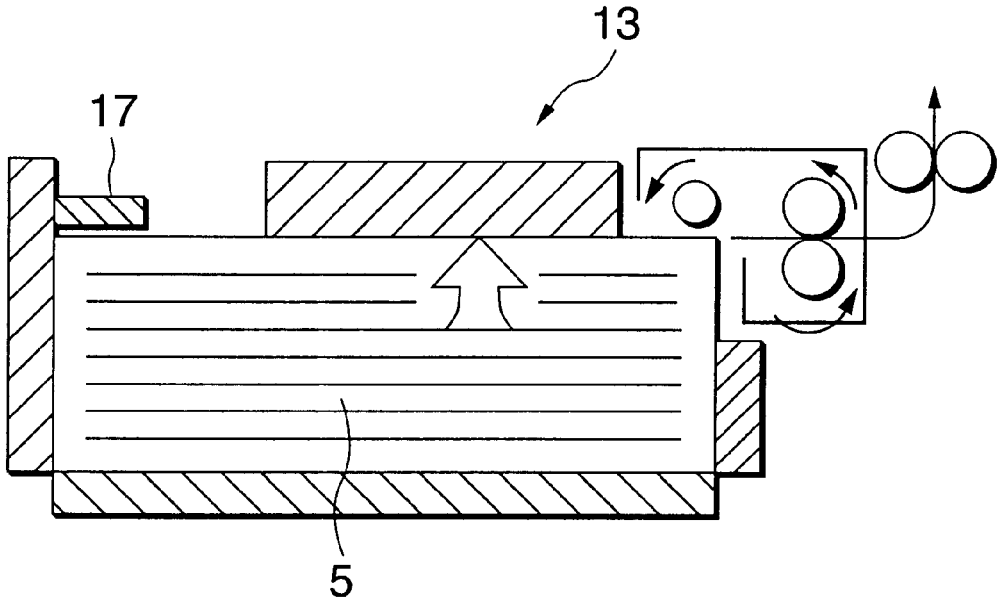
FIG. 26 is a cross-sectional view taken across line A—A shown in FIG. 25.
Figure 27:
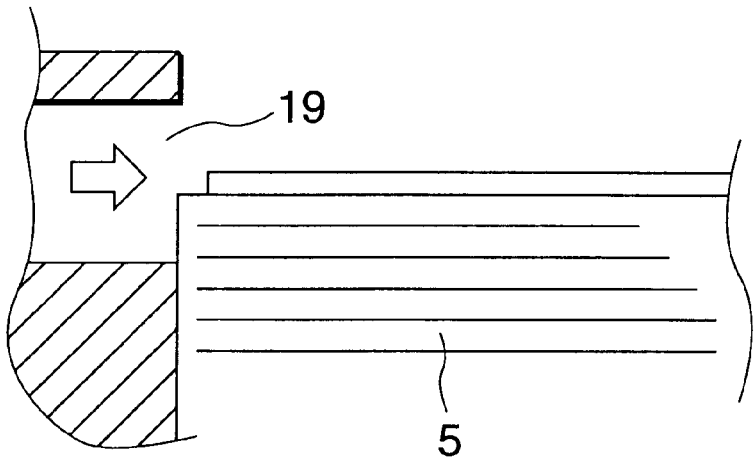
FIG. 27 is a cross-sectional view taken across line B—B shown in FIG. 25.
Figure 28A:
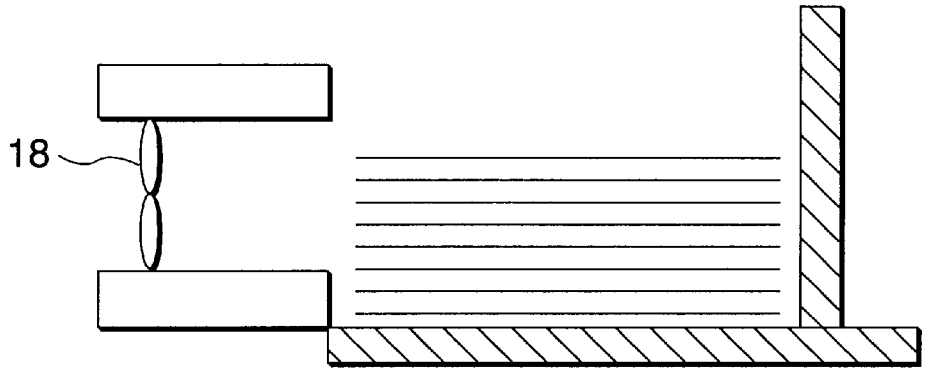
FIGS. 28A to 28C are explanatory views showing an existing paper feeder in which sheets are in a lifted state while they are bundled.
Figure 28B:
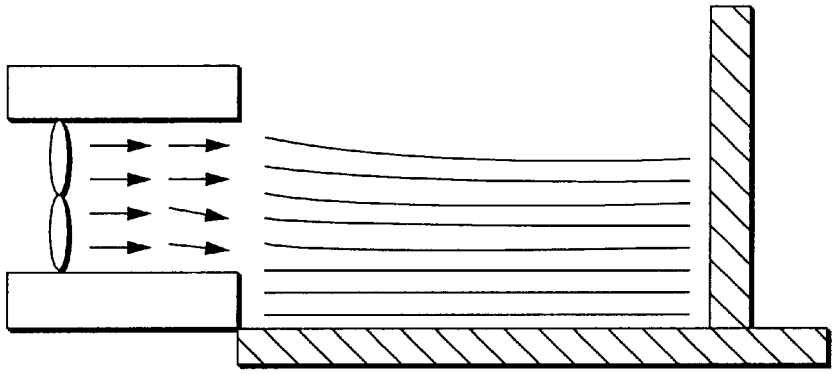
Figure 28C:
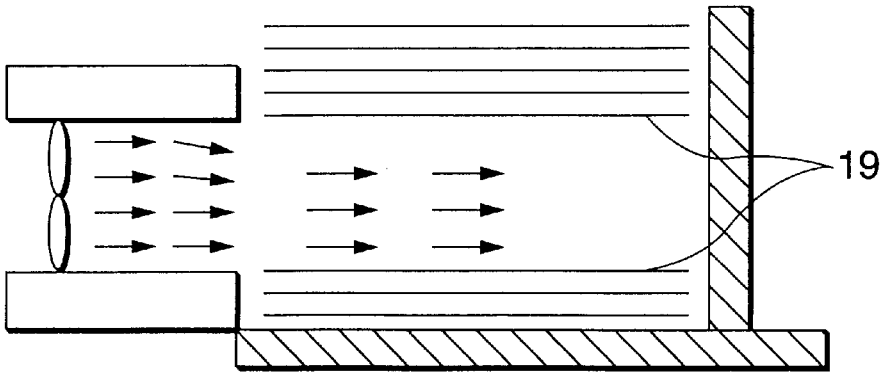

An image forming apparatus according to a twelfth embodiment of the present invention will now be described. FIG. 22A is a cross-sectional view which shows the paper feeder according to the twelfth embodiment and which is taken across in the direction in which the air is blown, and FIG. 22B is a cross-sectional view of the paper feeder taken in the direction orthogonal to the direction shown in FIG. 22A. FIG. 23 is an explanatory view showing the extent to which sheets are raised or lowered in the twelfth embodiment.

A paper feeder 175 of the foregoing image forming apparatus includes the paper feed tray 59; paper feed device 60; the air blowing device 71; and sheet raising and lowering device 177 which raises or lowers the sheets 57 loaded on the tray.

The sheet raising and lowering device 177 includes a bottom plate 179 provided along the bottom of the paper feed tray 59; an arm 181 which comes into frictional contact with the lower surface of the bottom plate 179; and the electric motor 121 for rotating the arm 181.

The bottom plate 179 is supported at the end opposite to the paper feed device 60 by the support shaft 183 in a pivotal manner. The end of the bottom plate 179 close to the paper feed device 60 is in frictional contact with the arm 181. Accordingly, the electric motor 121 is activated to rotate the arm 181, thereby causing the arm 181 to push the end of the bottom plate 179 and raising or lowering the sheets 57 loaded on the bottom plate 179.

In the paper feeder 175 according to the twelfth embodiment, the sheets 57 are vertically moved with respect to the passage of the inactive air blowing device 71 by pivotal actuation of the bottom plate 179. As a result, the passage of the air blowing device 71 is moved relatively to the sheets 57, causing the air to be blown toward the side edges of the sheets 57 in the direction from top to bottom.

As shown in FIG. 23, even in this embodiment, the extent H in which the sheets 57 are moved is set in such a way that at least the topmost sheet 57 crosses the passage of the air blowing device 71.

In the foregoing image forming apparatus, the sheets 57 are raised or lowered while the air blowing device 71 is stationary, thus causing the sheets 57 to move relatively to the passage of the air blowing device. Consequently, the passage of air can be moved without use of the air interruption device, the direction changing device, or the movable device for actuating the overall air blowing device, rendering the structure of the image forming apparatus comparatively simple.

Since the sheet raising-and-lowering device 177 is actuated in such a way that the topmost sheet 57 crosses the passage of air, air can be blown toward the topmost sheet 57 without fail.

An image forming apparatus according to a thirteenth embodiment of the present invention will now be described.

The image forming apparatus according to the thirteenth embodiment is substantially the same in structure as that previously described for the twelfth embodiment, and hence it is omitted from the drawings. The image forming apparatus according to this embodiment is characterized by the feature that the air blowing device and the electric motor are activated in synchronism with each other. More specifically, in the paper feeder according to the present embodiment, while the sheets are held in an elevated position by means of the sheet raising-and-lowering device, the air blowing device are actuated so as to blow air toward the sheets.

In the foregoing image forming apparatus, the air blowing device and the sheet raising-and-lowering device are activated in synchronism with each other, eliminating unnecessary operations of only the air blowing device or sheet raising-and-lowering device. Accordingly, the energy used for separating sheets can-be minimized.

An image forming apparatus according to a fourteenth embodiment of the present invention will now be described.

The image forming apparatus includes at least the air blowing device and an operation section. When the operation section is operated, operations of the air blowing device and the air-passage moving device or those of the air blowing device and the sheet raising-and-lowering device are commenced.

Accordingly, operations of the air blowing device and the air-passage changing device or those of the air blowing device and the sheet raising-and-lowering device are commenced before a paper feed start signal is received, thus separating sheets. As a result, paper can be immediately fed upon receipt of the paper feed start signal.

In the image forming apparatus, since ten and several sheets are separated in order from top before arrival of the paper feed start signal, sheets can be immediately fed upon receipt of a paper feed signal.

An image forming apparatus according to a fifteenth embodiment of the present invention will be described.

An image forming apparatus according to the present embodiment is used as a printer. The printer includes at least such as those shown in FIG. 1: that is, an image forming section including the receiving section 29, the image writing device 31, the image record-and-controlling section 33, the image carrier 35, the electrostatic charger 37, and the developer 39; and the paper feeder including the paper feed tray 59, the paper feed device 60, the air blowing device 67, and the foregoing air-passage moving device (or the sheet raising-and-lowering device or the like).

Information to be printed in, e.g., a page description language, is transmitted to the printer from the external device 25, such as a personal computer or the like, via the communications line 27. The communications line 27 is connected to the receiving section 29 which transfers the information to be printed to the image recording-and-controlling section 33. The image recording-and-controlling section 33 interprets the information to be printed and develops it into bit map data having a printable solution. The image writing device 31 writes an electrostatic image on the image carrier 35 on the basis of the thus-developed bit map data.

The air blowing device 71 is operated after the receiving section 29 has received the information to be printed and before a paper feed signal is received. It is desirable to activate the air-passage changing device or the sheet raising-and-lowering device in synchronism with the air blowing device 71. More specifically, it is though that operations of these device are commenced under several conditions: that is, when the receiving section 29 starts or finishes a receiving operation, when interpretation of the information to be printed is commenced, or when preparation of a given amount of bit map data is completed.

In the image forming apparatus, since sheets can be separated on the basis of a received image formation signal, sheets can be immediately fed upon receipt of the paper feed signal.

The image forming apparatus in each of the foregoing embodiments is capable of activating the air blowing device, the air interruption device, the direction changing device, or the sheet raising-and-lowering device at the following timing:

during a paper feeding operation;

when the paper feed tray is replenished with sheets;

when power is applied to the image forming apparatus;

when the power forming apparatus is in a standby condition; or when a paper feed preparation button is pressed in a case where the image forming apparatus is provided with the button.

The air blowing device 71 may be designed so as to change the amount of air supply between when a paper feeding operation is performed and when the image forming apparatus is in other conditions.

Controlling the amount of air supply in such a manner enables power consumption to be reduced by reducing the amount of air supply during a paper feeding operation.

Although the separation of sheets performed by the paper feed section has been described for each of the previous embodiments by reference to a case where sheets are separated through use of an active regard roll feeder (ARRF), the image forming apparatus according to the present invention can offer advantageous results which are the same as that yielded through use of ARRF even when the sheets are separated through use of existing techniques such as a friction regard roll feeder (FRRF) in which sheets are separated by means of a difference in frictional force between a feed roller and a retard roller or a friction retard roll pad feeder (FRPF) in which sheets are separated by means of a difference in frictional force between a feed roller and a retard pad.

As has been described in detail, under the paper feeding method according to the present invention, an air-passage narrowing section which narrows down the passage of air blows air toward the side edges of sheets and controls an air flow so as to produce negative pressure in the area above the sheets. The sheets can be separated by means of lift stemming from the negative pressure in cooperation with dynamic pressure applied to the side edges of the sheets, thus producing a great force to separate sheets with a small amount of air supply.

Since the image forming apparatus according to the present invention is provided with an air supply opening through which air is blown toward the sheets and an air-passage narrowing section which narrows down the flow of air supplied from an air supply passage to an air flow to be blown from the air supply opening. A negative pressure region can be formed in the area above the side edges of the sheets by means of the air-passage narrowing section, and the lift stemming from the negative pressure and the dynamic pressure applied to the side edges of the sheets can be exerted on the side edges of the sheets at one time. Consequently, a great force to separate sheets can be produced with a simple structure, and it is possible to realize a compact and low-noise image forming apparatus, as well as to reduce the cost of products and running costs.

In the image forming apparatus equipped with air-passage moving device, the passage of air is moved in the direction from top to bottom with respect to the side edges of the sheets by means of the air-passage moving device, enabling air to be blown toward sheets in order from top to bottom. Accordingly, it is possible to prevent separation of a group of upper sheets along weakly-attached sheets, which would otherwise be caused by blowing air toward the side edges of the sheets at one time. Consequently, all the sheets can be separated without fail in order from top to bottom, preventing feeding failures or feeding of overlapped sheets.

What is claimed is:

1. A sheet feeder comprising:

air blowing means which blows air from a direction of side edges of a stack of sheets loaded in a predetermined location;

paper feed means which separates one sheet from the stack of sheets to which air is blown by the air blowing means and which feeds the thus-separated sheet from the predetermined location; and air flow regulation means which is provided in an elevated position above the stack of sheets loaded in the predetermined location and which regulates the passage of the air flow blow toward the stack of sheets from the air blowing means, the air flow regulation means having a shape which regulates the air flow in such a way that a maximum negative pressure is produced from the air flow blown by the air blowing means in an area above an upper surface of the sheet in a vicinity of the side edges of the stack of sheets.

2. The sheet feeder as defined in claim 1, wherein the air flow regulation means has a shape which regulates the air flow in such a way that the maximum negative pressure is produced from the air flow blown by the air blowing means, in an area closer to a center of the stack of sheets than to the side edges of the stack of sheets loaded in the predetermined location.

3. A sheet feeder comprising:

air blowing means which blows air from a direction of side edges of a stack of sheets loaded in a predetermined location;

paper feed means which separates one sheet from the stack of sheets to which air is blown by the air blowing means and which feeds the thus-separated sheet from the predetermined location; and air flow regulation means which is provided in an elevated position above the stack of sheets loaded in the predetermined location and which regulates the passage of the air flow blow toward the stack of sheets from the air blowing means, wherein the air flow regulation means has a tapered surface which is formed in such a way that a distance between an upper surface of the sheet and the tapered surface increases with an increase in distance from the air blowing means.

* * * * *